US009723872B2

(12) United States Patent
Liu

(10) Patent No.: US 9,723,872 B2
(45) Date of Patent: Aug. 8, 2017

(54) ELECTRONIC CIGARETTE AND SOFT POWER SOURCE STEM THEREOF

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 1056 days.

(21) Appl. No.: 13/945,003

(22) Filed: Jul. 18, 2013

(65) Prior Publication Data

US 2014/0182611 A1 Jul. 3, 2014

Related U.S. Application Data

(63) Continuation-in-part of application No. PCT/CN2012/087870, filed on Dec. 28, 2012.

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 47/00*** | (2006.01) |

(52) U.S. Cl.

CPC ..... *A24F 47/008* (2013.01)

(58) Field of Classification Search

None

See application file for complete search history.

(56) References Cited

U.S. PATENT DOCUMENTS

2005/0016550 A1* 1/2005 Katase ..... A24F 47/002 131/194
2008/0092912 A1* 4/2008 Robinson ..... A24F 47/008 131/200
2010/0242974 A1* 9/2010 Pan ..... A24F 47/008 131/273

FOREIGN PATENT DOCUMENTS

CN 101606757 A * 12/2009
WO PCT/CN2012/087870 12/2012

* cited by examiner

*Primary Examiner* — Michael H Wilson
*Assistant Examiner* — Phu Nguyen
(74) *Attorney, Agent, or Firm* — Cheng-Ju Chiang

(57) ABSTRACT

The present invention provides an electronic cigarette and a soft power source stem thereof. The power source stem includes a power source stem sleeve with a built-in battery. One end of the power source stem sleeve is closed, while the other end thereof is provided with an absorption stem connector for connecting with an absorption stem of the electronic cigarette. Herein, the power source stem sleeve is made of soft material; and an outer wall of the power source stem sleeve is sleeved with a holding member for clamping the absorption stem connector and power source stem sleeve. The electronic cigarette and a soft power source stem have good experience when held in hand, are able to reduce production cost, have stable construction and are convenient to attach a paper layer thereon.

12 Claims, 6 Drawing Sheets

ELECTRONIC CIGARETTE AND SOFT POWER SOURCE STEM THEREOF

CROSS-REFERENCE TO RELATED APPLICATION

This application is a continuation-in-part application of International (PCT) Patent Application No. PCT/CN2012/087870, filed on Dec. 28, 2012, now pending and designating the United States. The entirety of the above-mentioned patent application is hereby incorporated by reference herein and made a part of this specification.

FIELD OF THE INVENTION

The present invention relates to field of electronic cigarette and more particularly, relates to an electronic cigarette with a soft power source stem.

BACKGROUND OF THE INVENTION

An electronic cigarette generally includes an absorption stem and a power source stem. The power source stem includes a power source stem sleeve for receiving a battery. The above sleeve is generally made of metal material such as steel, copper or aluminum.

A prior art power source stem suffers from the following drawbacks: the power source stem sleeve of the power source stem is constructed of metal and as the metal is hard material, it will produce less comfortable experience when held by hand of a smoker. In addition, using of metal material results in high cost for the power source stem. Moreover, it is inconvenient to attach paper layer such as trademarks and advertisement onto the outer wall of the metal power source stem sleeve.

SUMMARY OF THE INVENTION

The object of the present invention is to provide an electronic cigarette soft power source stem which is capable of producing comfortable experience when held by hand of a smoker, saving production cost, with stable construction, and is convenient for attaching paper layer thereon.

To realize the above object, the present invention provides an electronic cigarette soft power source stem including a power source stem sleeve with a built-in battery. One end of the power source stem sleeve is closed, while the other end thereof is provided with an absorption stem connector for connecting with an absorption stem of the electronic cigarette. Herein, the power source stem sleeve is made of soft material; and an outer wall of the power source stem sleeve is sleeved with a holding member for clamping the absorption stem connector and power source stem sleeve.

Herein, the outer wall of the power source stem sleeve is wrapped with a paper layer for advertisement or trademark use.

Herein, the holding member is a circular holding ring.

Herein, the absorption stem connector includes a connection bushing and a power source electrode member sleeved on the middle portion of the connection bushing by an insulation ring. The power source electrode member and connection bushing are electrically connected with the positive and negative electrodes of the battery respectively.

Herein, the connection bushing is of a cylinder shape and its outer wall is tightly pressed against and secured on the inner wall of the power source stem sleeve; the inner wall of the connection bushing is provided with an internal thread and a holding groove for holding the power source electrode member; and the power source electrode member is sleeved on the middle portion of the connection bushing by the insulation ring.

Herein, the power source stem further includes a control component and a control component bracket; the control component bracket is secured on the inner wall of the power source stem sleeve, while the control component is secured in the control component bracket and is electrically connected with the battery.

Herein, a base cover independent of the power source stem sleeve is inserted into the other end of the power source stem sleeve opposite to the absorption stem connector to seal the power source stem sleeve; a holding member is also disposed on the outer wall of the power source stem sleeve at a connection portion between the base cover and power source stem sleeve for clamping them together.

Herein, the soft material is plastic, paper, rubber, silica gel or fiber; the plastic material is any one of the following materials: PC, PP, PVC, ABS, PET or PE; the paper material includes paper having desired hardness; and the fiber material includes chemical fiber tube, wood pulp fiber or glass fiber tube.

The invention also provides an electronic cigarette including an absorption stem and power source stem. Herein, the power source stem is the soft power source stem as described above. The absorption stem is connected with the absorption stem connector of the soft power source stem detachably. The absorption stem includes an absorption stem sleeve, an atomizer and a cigar liquid cup both of which are positioned in the absorption stem sleeve. Both ends of the absorption stem sleeve are provided with a nozzle case and a power source stem connector for being connected with the power source stem.

Herein, the absorption stem sleeve is made of soft material. One end of the power source stem connector is inserted into the absorption stem sleeve and is pressed tightly against the inner wall thereof; while the other end thereof is provided with an externally threaded connector for connecting with the power source stem.

Herein, the nozzle case is a part of the cigar liquid cup. The cigar liquid cup includes a cup base and a nozzle case, both of which are opposite to and distanced from each other, and are both pressed tightly upon the inner wall of the sleeve, and a liquid storage component held between the cup base and nozzle case.

Herein, the liquid storage component is of a cylinder shape. A through hole is defined in a middle portion of the liquid storage component. The nozzle case includes a cylindrical cover body and a first locating post located at one end of the cover body and extended axially from the middle portion of the cover body. A nozzle case venting hole is defined in the middle portion of the nozzle case and is extended axially through the cover body and first locating post. The cup base is of a cylindrical cup construction defined by a side wall and a bottom wall together and a hollow chamber is defined therein. A second locating post is extended axially from the bottom wall of the cup base. A circular cavity for receiving the liquid storage component is defined between the second locating post and inner wall of the cup base. A cup base venting hole is defined at the middle portion of the cup base and extends axially through the second locating post and bottom wall. The first locating post of the nozzle case is corresponding to the second locating post of the cup base, and the two posts are inserted into the through hole of the liquid storage component to secure the two ends of the liquid storage component.

Herein, the atomizer includes an electric heater coil and a fiber member for supporting the electric heater coil and absorbing cigar liquid. The fiber member is secured in the through hole along radial direction of the liquid storage component. Both ends of the fiber member are pressed against the liquid storage component so as to absorb cigar liquid which will be atomized by the electric heater coil. The electric heater coil is wrapped on the fiber member. Both ends of the electric heater coil are pressed against the side wall of the through hole and pass across the cigar liquid cup and then electrically connected with the positive and negative electrodes of the power source stem connector respectively. A wire guiding hole is defined in the bottom wall of the cup base of the cigar liquid cup and is extended axially through the bottom wall for passing of the electric heater coil. The interface between the electric heater coil and wire guiding hole is sealed.

Herein, the power source stem connector includes a connection member working as a first electrode of the atomizer, an absorption stem electrode member functioning as a second electrode of the atomizer, and an insulation member for insulating the connection member from the absorption stem electrode member. The connection member is substantially of a hollow cylinder shape and includes a cylindrical main body with a larger diameter and a cylindrical connection portion with a smaller diameter. A locating rim is disposed between the main body and connection portion and extends radially outwardly from the main body for matching the connection end of the sleeve. The main body is inserted and secured into the sleeve. An externally threaded connector for connecting with the power source stem and an intake hole for air entrance are disposed on the connection portion. A holding groove is defined in the inner wall of the connection member for mounting the absorption stem electrode member therein. The absorption stem electrode member is inserted into the holding groove by the insulation member. A venting hole extended axially is defined in a middle portion of the absorption stem electrode member.

The embodiments of the present invention have the following advantageous effects: due to construction of the power source stem sleeve of the soft power source stem made of soft material, it brings good experience when held in hand. In addition, use of soft material makes saving of production cost of the power source stem sleeve. Moreover, paper layer for showing commercials or trademark can be easily adhered to the outer wall of the soft power source stem sleeve. Because the holding ring is provided on the outer wall of the power source stem sleeve at the connection region between the absorption stem connector and base cover, the entire enclosure has stable structure.

The embodiments of the invention are described in detail in conjunction with the accompanying drawings.

DETAILED DESCRIPTION OF THE INVENTION

It is noted that, in case no interference is resulted in, the embodiments and features contained therein may be combined with each other. The present invention is described in greater detail in conjunction with the accompanying drawings and embodiments.

Figure 1:
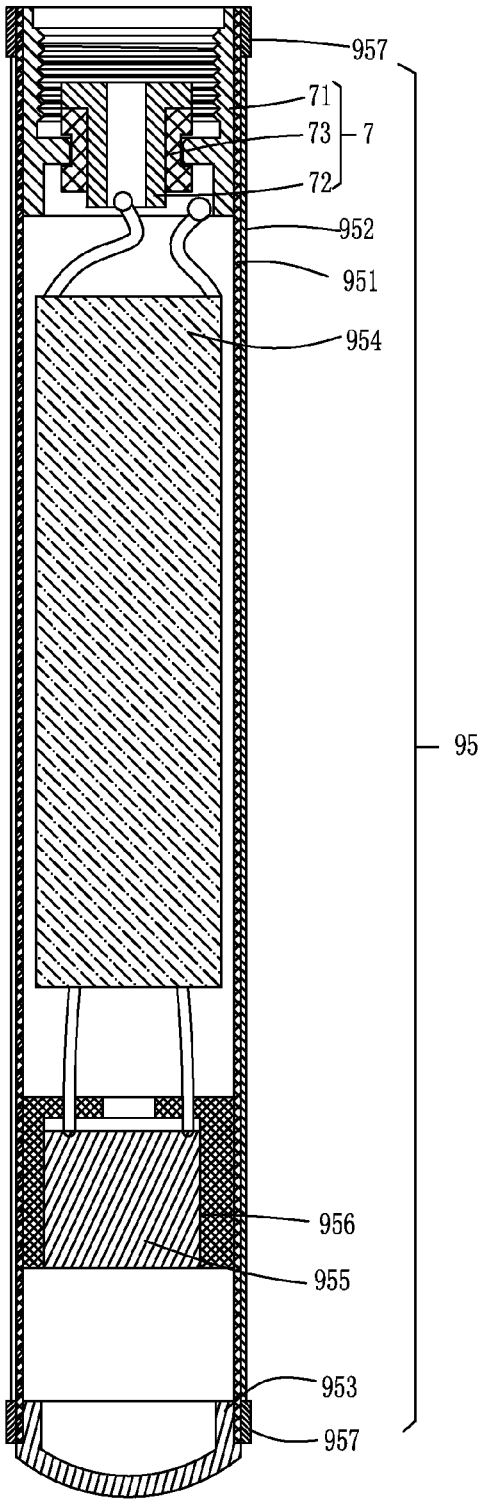
FIG. 1 is a cross-sectional view of an electronic cigarette soft power source stem of the present invention.
Figure 2:
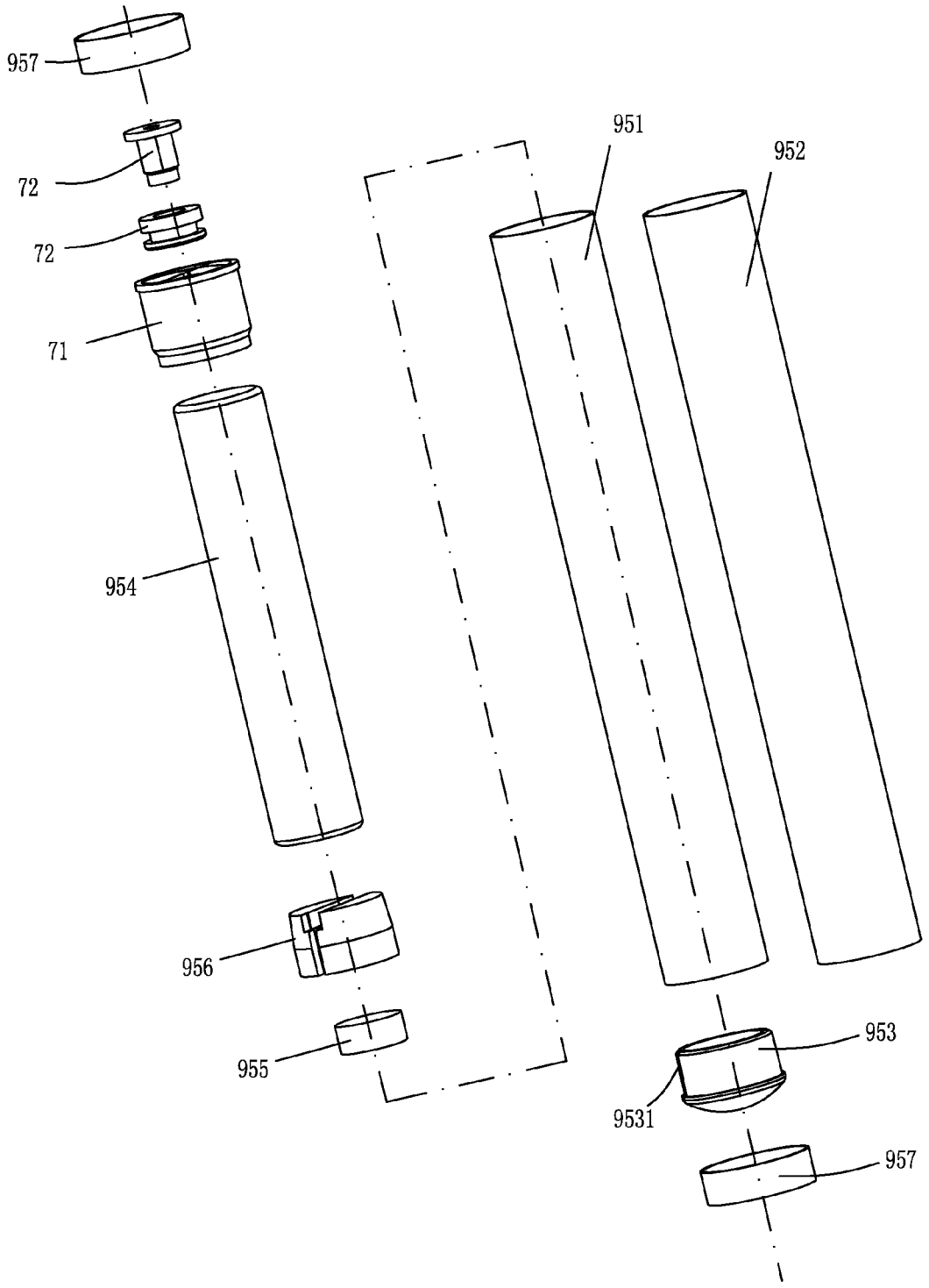
FIG. 2 is an exploded view of an electronic cigarette soft power source stem of the present invention.
Figure 3:
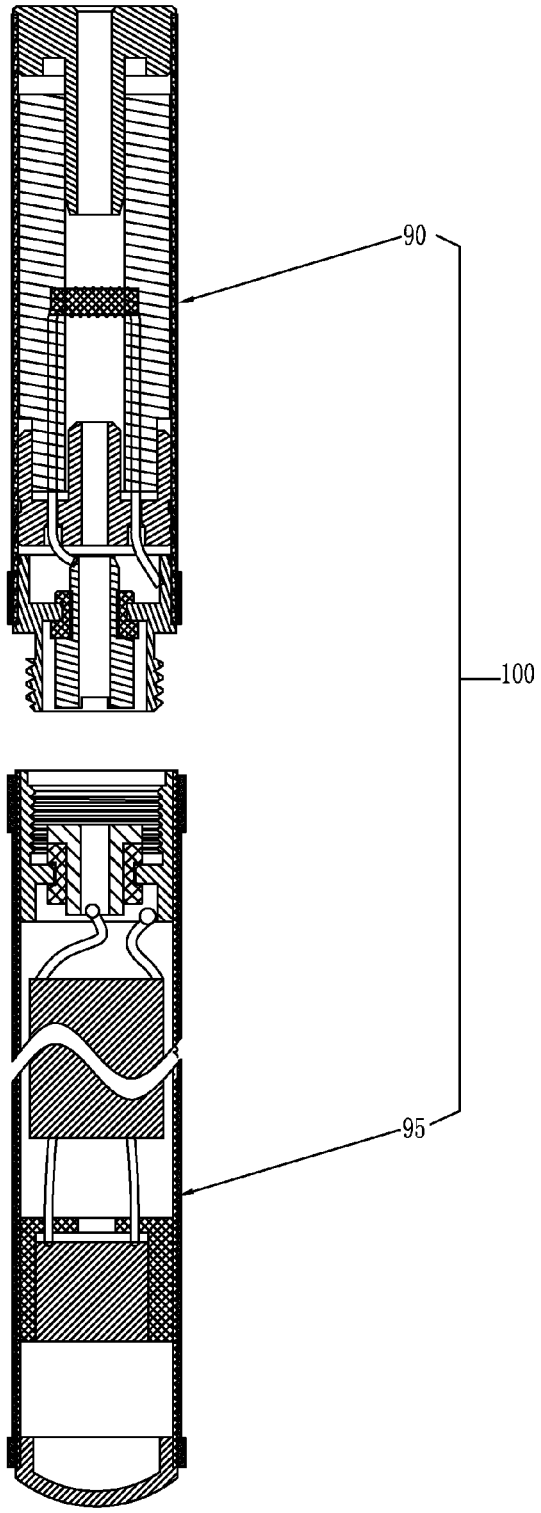
FIG. 3 is a cross-sectional view of an electronic cigarette of the present invention.

As shown in FIGS. 1-2, the present invention provides an electronic cigarette soft power source stem 95 which includes a power source stem sleeve 951, an absorption stem connector 7 disposed at one end of the power source stem sleeve 951, a base cover 953 disposed at the other end of the power source stem sleeve 951, a paper layer 952 attached onto an outer wall of the power source stem sleeve 951 for advertisement or trademark use, a battery 954 positioned inside the power source stem sleeve 951, a control component 955, and a control component bracket 956. The absorption stem connector 7 is inserted into the power source stem sleeve 951 and is tightly pressed against and secured on the inner wall of the power source stem sleeve 951. A holding mechanism is disposed on the outer wall of the power source stem sleeve 951 for clamping the absorption stem connector 7 and power source stem sleeve 951. In this embodiment, the holding mechanism is a circular holding ring 957. For facilitating description, the direction shown in FIG. 3 is referred to.

The power source stem sleeve 951 is a cylinder with hollow chamber, and is made of soft material with required strength and flexibility, and the soft material may include plastic, paper, rubber, silica gel or fiber material. The plastic material may be any one of the following materials: PC, PP, PVC, ABS, PET or PE. The paper material may include paper having desired hardness such as food package paper, bond paper, fiber paper, coated paper or brown paper. The fiber material may include fiber tube, wood pulp fiber or glass fiber tube. As made of soft material, the power source stem sleeve 951 produces good experience when held in hand. In addition, using of soft material also reduces manufacture cost. Furthermore, a paper layer 952 may easily stick on the outer wall of the power source stem sleeve 951. The paper layer 952 matches with the power source stem sleeve 951 and is also of a cylindrical shape. The paper layer 952 is sleeved on the outer wall of the power source stem sleeve 951. In addition, the paper layer 952 may also be made of soft material to guarantee flexibility of the entire power source stem 95 after being sleeved on the power source stem sleeve. For example, the paper layer may be made of soft material such as label paper or self-adhesive paper.

The absorption stem connector 7 is intended for connection with the absorption stem 90 which will be described later and is composed of a connection bushing 71, a power source electrode member 72 and an insulation ring 73. The connection bushing 71 is of a cylinder shape and its outer wall is tightly pressed against and secured on the inner wall of the power source stem sleeve 951. The inner wall of the connection bushing 71 is provided with an internal thread and a holding groove for holding the power source electrode member 72. The power source electrode member 72 is sleeved on the middle portion of the connection bushing 71 by the insulation ring 73. That is, the member 72 is held in the holding groove. The power source electrode member 72 and connection bushing 71 are respectively electronically connected to the positive and negative electrodes of the battery 954. An intake hole 9531 is defined in the base cover 953 permitting entrance of external air into the power source stem 95. The control component 955 is used for control operation of the entire electronic cigarette and is provided with a mini pneumatic switch for control conduction of the electric circuit such that the electronic cigarette starts to work. The control component bracket 956 is secured on the inner wall of the power source stem sleeve 951, while the control component 955 is secured in the control component bracket 956 and is electrically connected with the battery 954. The control component bracket 956 includes a receiving groove for receiving the control component 955 and a venting hole running axially (not shown).

As shown in FIGS. 3-8, the present invention also provides an electronic cigarette 100 incorporating the electronic cigarette soft power source stem 95 aforementioned. The electronic cigarette includes an absorption stem 90 connected with the absorption stem connector 7 of the soft power source stem 95 detachably. In this embodiment, the absorption stem 90 and power source stem 95 are connected with each other by threaded manner, or insertion manner or snap connection. The absorption stem 90 includes an absorption stem sleeve 1, an atomizer 2 and a cigar liquid cup 3 both of which are positioned in the sleeve 1. Both ends of the absorption stem sleeve 1 are provided with a nozzle case 4 and a power source stem connector 5 for being connected with the power source stem 95.

Figure 4:
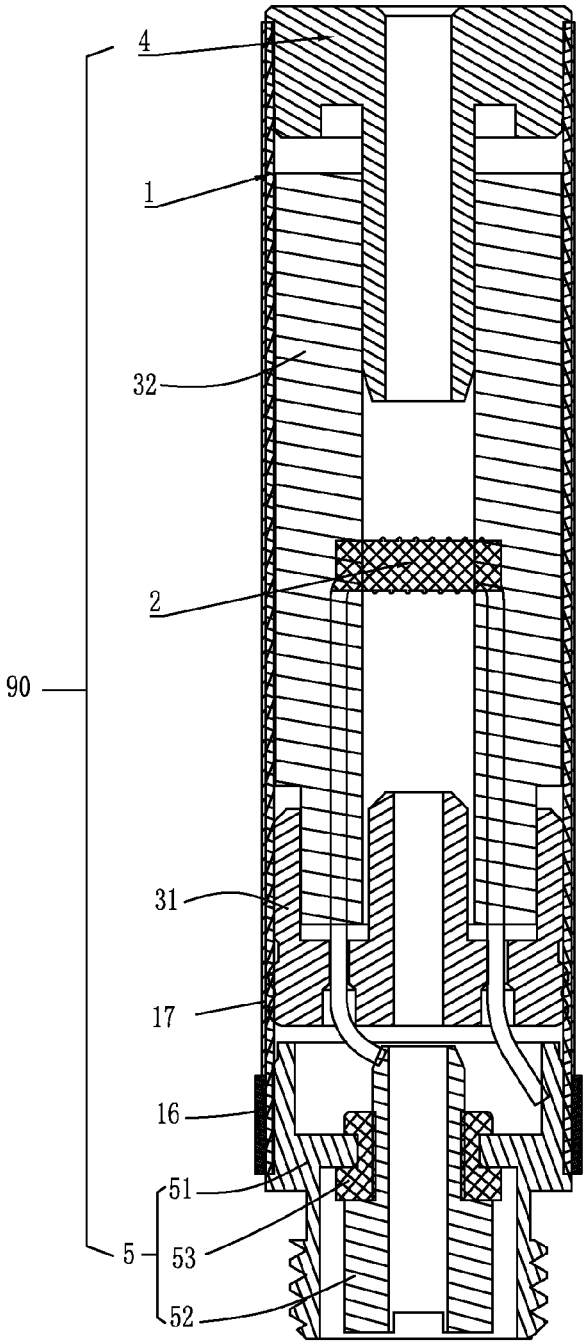
FIG. 4 is a cross-sectional view of an absorption stem of an electronic cigarette of the present invention.

As shown in FIG. 4, the absorption stem sleeve 1 is made of the same soft material as the power source stem sleeve 951. As made of soft material, the absorption stem sleeve 1 produces good experience when held in hand. In addition, using of soft material also reduces manufacture cost. Furthermore, a paper layer may easily stick on the outer wall of the absorption stem sleeve 1 for showing trademarks or advertisement. One end of the power source stem connector 5 is inserted into the absorption stem sleeve 1 and is pressed tightly against the inner wall thereof. A holding member is sleeved on the outer wall of the absorption stem sleeve 1 at the connection portion there-between for tightly clasping the sleeve 1 and power source stem connector 5. In this embodiment, the holding member is a circular holding ring 16 identical to the circular holding ring 957. A paper layer 17 for showing commercials or trademark surrounds the outer wall of the absorption stem sleeve 1. The paper layer 17 is identical to the paper layer 952. One end of the paper layer 17 is pressed against the holding ring 16 such that the absorption stem sleeve 1 is wrapped with the paper layer 17 and holding ring 16 together.

The atomizer 2 includes an electric heater coil 211 and a fiber member 212 for supporting the electric heater coil 211 and absorbing cigar liquid. The fiber member 212 works like sponge so as to absorb and store cigar liquid, and may be made of material with good liquid absorption and storage ability such as glass fiber or cotton.

In this embodiment, for making the internal construction of the absorption stem 90 more compact, the nozzle case 4 is part of the cigar liquid cup 3. The cigar liquid cup 3 includes a cup base 31 and a nozzle case 4 which are opposite to and distanced from each other and are both pressed tightly upon the inner wall of the sleeve 1, and a liquid storage component 32 held between the cup base 31 and nozzle case 4.

Figure 6:
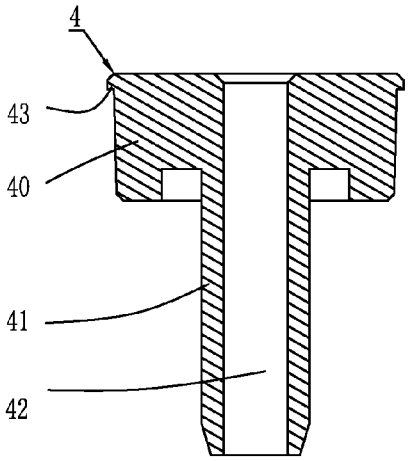
FIG. 6 is a cross-sectional view of a nozzle case of an absorption stem of an electronic cigarette of the present invention.

As shown in FIG. 6, the nozzle case 4 includes a cylindrical cover body 40 and a first locating post 41 located at one end of the cover body 40 and extended axially from the middle portion of the cover body 40. A nozzle case venting hole 42 is defined in the middle portion of the nozzle case 40 and is extended axially through the cover body 40 and first locating post 41. A locating rim 43 is provided on the outer wall of the cover body 40 for matching the end portion of the absorption stem sleeve 1. The outer wall of the cover body 40 is pressed against the inner wall of the sleeve 1. In addition, the cover body 40 is held in place by the locating rim 43. In addition, the connection interface between the cover body 40 and locating rim 43 is filled and sealed with the glue. The nozzle case 4 may be made of soft material such as silica gel, rubber, PVC, TPU or PE so that it produces good experience when held in mouth and also leads to low cost.

The liquid storage component 32 is of a cylinder shape for absorbing and storing cigar liquid flowed into the cigar liquid cup 3 so that the cigar liquid is atomized later by the atomizer 2. The liquid storage component 32 functions as sponge for liquid absorption and storage, and may be made of material capable of absorbing and storing cigar liquid such as non-woven fabrics, wood pulp cotton, chemical fiber or PVA. A through hole 321 is defined in a middle portion of the liquid storage component 32 for venting and mounting the atomizer 2. One end, which is engaged with the cup base 31, of the liquid storage component 32, is provided with a stepped axis-like recess 322 (as shown in FIG. 5) for realizing insertion between it and cup base 31.

Figure 7:
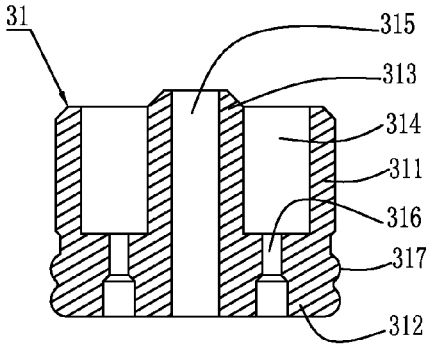
FIG. 7 is a cross-sectional view of a cup base of an absorption stem of an electronic cigarette of the present invention.

As shown in FIG. 7, the cup base 31 is of a cylindrical cup construction and includes a side wall 311 and a bottom wall 312. A second locating post 313 is extended axially from the bottom wall 312 of the cup base 31. A circular cavity 314 for receiving the liquid storage component 32 is defined between the second locating post 313 and inner wall of the cup base 31. A cup base venting hole 315 is defined at the middle portion of the cup base 31 and extends axially through the second locating post 313 and bottom wall 312. A wire guiding hole 316 is defined in the bottom wall 312 and is extended axially. A circular sealing ring 317 is provided on the outer wall of the cup base 31 for being tightly pressed against the inner wall of the absorption stem sleeve 1.

As shown in FIG. 6, the first locating post 41 of the nozzle case 4 corresponds to the second locating post 313 of the cup base 31. Both of the locating posts are inserted into the though hole 321 of the liquid storage component 32 so as to secure both ends of the liquid storage component 32 such that the component 32 is supported in the cigar liquid cup 3, thereby no deformation being generated and having required strength. By this manner, the risk of cigar liquid inside the liquid storage component 32 being squeezed out of the component 32 due to squeezing of the absorption stem 90 of the soft enclosure when smoking is eliminated or reduced.

Figure 5:
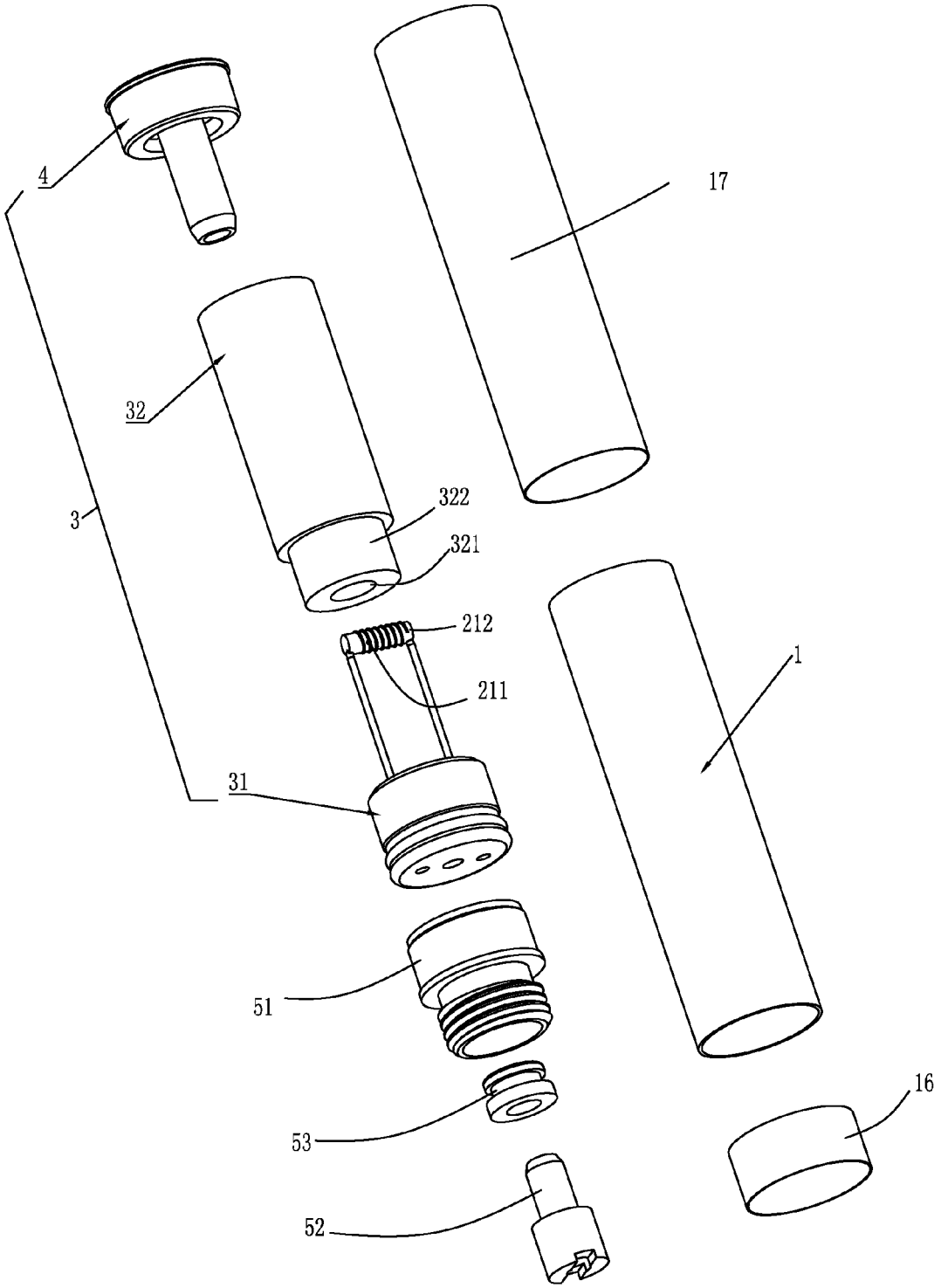
FIG. 5 is an exploded view of an absorption stem of an electronic cigarette of the present invention.

As shown in FIGS. 4-5, the fiber member 212 is secured in the through hole 321 along radial direction of the liquid storage component 32. Both ends of the fiber member 212 are pressed against the liquid storage component 32 so as to absorb cigar liquid which will be atomized by the electric heater coil 211. The electric heater coil 211 is wrapped on the fiber member 212. Both ends of the electric heater coil 211 are pressed against the side wall of the through hole 321 and pass across the wire guiding hole (not labeled) of the bottom wall of the cup base 31 and then electrically connected with the positive and negative electrodes of the power source stem connector 5 respectively. The interface between the electric heater coil 211 and wire guiding hole is sealed.

Figure 8:
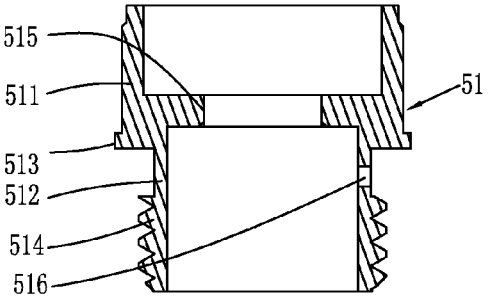
FIG. 8 is a cross-sectional view of a connection member of an absorption stem of an electronic cigarette of the present invention.

As shown in FIGS. 4-5, the power source stem connector 5 includes a connection member 51 which functions as a first electrode (for example the negative electrode) of the atomizer 2, an absorption stem electrode member 52 functioning as a second electrode (for example the positive electrode) of the atomizer 2, and an insulation member 53 for insulating the connection member 51 from the absorption stem electrode member 52. As shown in FIG. 8, the connection member 51 is substantially of a hollow cylinder shape and includes a cylindrical main body 511 with a larger diameter and a cylindrical connection portion 512 with a smaller diameter. A locating rim 513 is disposed between the main body 511 and connection portion 512 and extends radially outwardly from the main body 511 for matching the connection end of the sleeve 1. The main body 511 is inserted and secured into the sleeve 1. An externally threaded connector 514 for connecting with the power source stem 95 and an intake hole 516 for air entrance are disposed on the connection portion 512. A holding groove 515 is defined in the inner wall of the connection member 51 for mounting the absorption stem electrode member 52 therein. The absorption stem electrode member 52 is inserted into the holding groove 515 by the insulation member 53. A venting hole (not shown) extended axially is defined in a middle portion of the absorption stem electrode member 52.

In addition, as shown in FIG. 4, external air travels into the power source stem 95 via the intake hole on the base cover 953 located at the bottom of the power source stem 95, then travels across the venting holes of the power source electrode member 72 and absorption stem electrode member 52, then across the venting hole of the cup base 31 of the cigar liquid cup 3 and through hole 321 of the liquid storage component 32, and finally flows out of the absorption stem 90 via the venting hole 42 of the nozzle case 4, thus forming a unique air path inside the electronic cigarette, and letting air flow smoothly between interior and exterior of the electronic cigarette. Of course, external air may also enters into the absorption stem electrode member 52 directly via the gap between the absorption stem 90 and power source stem 95 and then via the intake hole 516 (as shown in FIG. 8) of the connection member 51. Before operation of the electronic cigarette, small amount of cigar liquid soaks through the liquid guiding member 52 and is stored in the fiber member 212. During operation, the electric heater coil 211 of the atomization device 2 works to generate heat such that the cigar liquid stored in the fiber member 212 is heated and changed to smoke. The smoke travels across the through hole 321 of the liquid storage component 32 and is finally absorbed by the smoker via the venting hole 42 of the nozzle case 4.

Though various embodiments of the invention have been illustrated above, a person of ordinary skill in the art will understand that, variations and improvements made upon the illustrative embodiments fall within the scope of the invention, and the scope of the invention is only limited by the accompanying claims and their equivalents.

What is claimed is:

1. An electronic cigarette comprising an absorption stem and power source stem; wherein the power source stem comprises a power source stem sleeve with a built-in battery; one end of the power source stem sleeve is capped with a base cover, while the other end of the power source stem sleeve is provided with an absorption stem connector for connecting with an absorption stem of the electronic cigarette; an outer wall of the power source stem sleeve is sleeved with a holding member for clamping the absorption stem connector and the power source stem sleeve;

the absorption stem is connected with the absorption stem connector of the power source stem detachably; the absorption stem includes an absorption stem sleeve, an atomizer and a cigar liquid cup both of which are positioned in the absorption stem sleeve; one end of the absorption stem sleeve is provided with a nozzle case and the other end of the absorption stem sleeve is provided with a power source stem connector for being connected with the power source stem; the liquid storage component is of a cylinder shape; a through hole is defined in a middle portion of the liquid storage component; the nozzle case includes a cylindrical cover body and a first locating post located at one end of the cover body and extended axially from the middle portion of the cover body; a nozzle case venting hole is defined in the middle portion of the nozzle case and is extended axially through the cover body and first locating post; the cup base is of a cylindrical cup construction defined by a side wall and a bottom wall together and a hollow chamber is defined therein; a second locating post is extended axially from the bottom wall of the cup base; a circular cavity for receiving the liquid storage component is defined between the second locating post and inner wall of the cup base; a cup base venting hole is defined at the middle portion of the cup base and extends axially through the second locating post and bottom wall; the first locating post of the nozzle case is corresponding to the second locating post of the cup base, and the two posts are inserted into the through hole of the liquid storage component to secure the two ends of the liquid storage component.

2. The electronic cigarette according to claim 1, wherein the outer wall of the power source stem sleeve is wrapped with a paper layer for advertisement or trademark use.

3. The electronic cigarette according to claim 1, wherein the holding member is a circular holding ring.

4. The electronic cigarette according to claim 1, wherein the absorption stem connector comprises a connection bushing and a power source electrode member sleeved on the middle portion of the connection bushing by an insulation ring; the power source electrode member and connection bushing are electrically connected with the positive and negative electrodes of the battery respectively.

5. The electronic cigarette according to claim 4, wherein the connection bushing is of a cylinder shape and its outer wall is tightly pressed against and secured on the inner wall of the power source stem sleeve; the inner wall of the connection bushing is provided with an internal thread and a holding groove for holding the power source electrode member; and the power source electrode member is sleeved on the middle portion of the connection bushing by the insulation ring.

6. The electronic cigarette according to claim 1, wherein the power source stem further comprises a control component and a control component bracket; the control component bracket is secured on the inner wall of the power source stem sleeve, while the control component is secured in the control component bracket and is electrically connected with the battery.

7. The electronic cigarette according to claim 1, wherein a base cover independent of the power source stem sleeve is inserted into the other end of the power source stem sleeve opposite to the absorption stem connector to cap the power source stem sleeve; another holding member is also disposed on the outer wall of the power source stem sleeve at a connection portion between the base cover and the power source stem sleeve for clamping them together.

8. The electronic cigarette according to claim 1, wherein the power source stem sleeve is made of a material which is plastic, paper, rubber, silica gel or fiber; the plastic material is any one of the following materials: PC, PP, PVC, ABS, PET or PE; and the fiber material includes chemical fiber tube, wood pulp fiber or glass fiber tube.

9. The electronic cigarette according to claim 1, wherein one end of the power source stem connector is inserted into the absorption stem sleeve and is pressed tightly against the inner wall thereof; while the other end of the power source stem connector is provided with an externally threaded connector for connecting with the power source stem.

10. The electronic cigarette according to claim 1, wherein the nozzle case is part of the cigar liquid cup; the cigar liquid cup includes a cup base and a nozzle case, which are opposite to and distanced from each other and are both pressed tightly upon the inner wall of the sleeve, and a liquid storage component held between the cup base and nozzle case.

11. An electronic cigarette comprising an absorption stem and power source stem; wherein the power source stem comprises a power source stem sleeve with a built-in battery; one end of the power source stem sleeve is capped with a base cover, while the other end of the power source stem sleeve is provided with an absorption stem connector for connecting with an absorption stem of the electronic cigarette; an outer wall of the power source stem sleeve is sleeved with a holding member for clamping the absorption stem connector and the power source stem sleeve;

the absorption stem is connected with the absorption stem connector of the power source stem detachably; the absorption stem includes an absorption stem sleeve, an atomizer and a cigar liquid cup both of which are positioned in the absorption stem sleeve; one end of the absorption stem sleeve is provided with a nozzle case and the other end of the absorption stem sleeve is provided with a power source stem connector for being connected with the power source stem;

the liquid storage component is of a cylinder shape; a through hole is defined in a middle portion of the liquid storage component the atomizer includes an electric heater coil and a fiber member for supporting the electric heater coil and absorbing cigar liquid; the fiber member is secured in the through hole along radial direction of the liquid storage component; both ends of the fiber member are pressed against the liquid storage component so as to absorb cigar liquid which will be atomized by the electric heater coil; the electric heater coil is wrapped on the fiber member; both ends of the electric heater coil are pressed against the side wall of the through hole and pass across the cigar liquid cup and then electrically connected with the positive and negative electrodes of the power source stem connector respectively; a wire guiding hole is defined in the bottom wall of the cup base of the cigar liquid cup and is extended axially through the bottom wall for passing of the electric heater coil; the interface between the electric heater coil and wire guiding hole is sealed.

12. An electronic cigarette comprising an absorption stem and power source stem; wherein the power source stem comprises a power source stem sleeve with a built-in battery; one end of the power source stem sleeve is capped with a base cover, while the other end of the power source stem sleeve is provided with an absorption stem connector for connecting with an absorption stem of the electronic cigarette; an outer wall of the power source stem sleeve is sleeved with a holding member for clamping the absorption stem connector and the power source stem sleeve;

the absorption stem is connected with the absorption stem connector of the power source stem detachably; the absorption stem includes an absorption stem sleeve, an atomizer and a cigar liquid cup both of which are positioned in the absorption stem sleeve; one end of the absorption stem sleeve is provided with a nozzle case and the other end of the absorption stem sleeve is provided with a power source stem connector for being connected with the power source stem; the power source stem connector includes a connection member which functions as a first electrode of the atomizer, an absorption stem electrode member functioning as a second electrode of the atomizer, and an insulation member for insulating the connection member from the absorption stem electrode member; the connection member is substantially of a hollow cylinder shape and includes a cylindrical main body with a larger diameter and a cylindrical connection portion with a smaller diameter; a locating rim is disposed between the main body and connection portion and extends radially outwardly from the main body for matching the connection end of the sleeve; the main body is inserted and secured into the sleeve; and an externally threaded connector for connecting with the power source stem and an intake hole for air entrance are disposed on the connection portion; a holding groove is defined in the inner wall of the connection member for mounting the absorption stem electrode member therein; the absorption stem electrode member is inserted into the holding groove by the insulation member; a venting hole extended axially is defined in a middle portion of the absorption stem electrode member.

* * * * *